US009970677B2

(12) United States Patent
Song et al.

(10) Patent No.: US 9,970,677 B2
(45) Date of Patent: May 15, 2018

(54) AIR-CONDITIONING VENT VANE ADJUSTING DEVICE

(71) Applicant: NINGBO RUNNER INDUSTRIAL CORPORATION, Zhejiang (CN)

(72) Inventors: Mao-Li Song, Zhejiang (CN); Hua-Liang Zuo, Zhejiang (CN); Zhi-Ping Zhang, Zhejiang (CN)

(73) Assignee: NINGBO RUNNER INDUSTRIAL CORPORATION, Ningbo (CN)

( * ) Notice: Subject to any disclaimer, the term of this patent is extended or adjusted under 35 U.S.C. 154(b) by 428 days.

(21) Appl. No.: 14/093,003

(22) Filed: Nov. 28, 2013

(65) Prior Publication Data

US 2014/0302768 A1 Oct. 9, 2014

(30) Foreign Application Priority Data

Apr. 7, 2013 (CN) ..... 2013 2 0167444 U

(51) Int. Cl.
*F24F 13/00* (2006.01)
*F24F 13/14* (2006.01)
*F24F 13/15* (2006.01)

(52) U.S. Cl.
CPC ..... *F24F 13/1426* (2013.01); *F24F 13/15* (2013.01)

(58) Field of Classification Search
CPC ..... F24F 13/082; F24F 13/12
USPC ..... 454/325, 314, 268
See application file for complete search history.

(56) References Cited

U.S. PATENT DOCUMENTS 3,391,629 A * 7/1968 Snell ..... F24F 13/075 454/290
3,683,786 A * 8/1972 Hedrick ..... F24F 13/15 454/313
4,876,951 A * 10/1989 Vork ..... F24F 13/1426 454/322
4,907,500 A * 3/1990 Brown ..... F24F 13/15 454/290
5,588,911 A * 12/1996 Gomez ..... F24F 11/02 454/290
6,033,304 A * 3/2000 Haynes ..... F24F 13/075 454/290
6,322,442 B1 * 11/2001 Cordell ..... F24F 13/06 454/290

(Continued)

FOREIGN PATENT DOCUMENTS

CN 201246856 Y * 5/2009
CN 201246856 Y 5/2009

*Primary Examiner* — Alissa Tompkins
*Assistant Examiner* — Frances F Hamilton
(74) *Attorney, Agent, or Firm* — Chun-Ming Shih

(57) ABSTRACT

An air-conditioning vent vane adjusting device includes a board for driving a vane to rotate, a push-button slidably installed on a panel, and a connecting plate fixedly attached to the board. A fixed plate is coupled to the push-button and is moved together with the push-button, and the fixed plate has a guide notch tilted with respect to the longitudinal direction of the board. The board has a lug accommodated in the guide notch and capable of sliding in the guide notch. With the tilted guide notch and the lug, the board can be moved reciprocally to overcome the problems of requiring a large operating force of the push-button of the tight assembly of the conventional board and connecting plate and the difficulty of opening and closing a vane.

2 Claims, 5 Drawing Sheets

(56) References Cited

U.S. PATENT DOCUMENTS

| | | | | |
|---|---|---|---|---|
| 6,848,990 | B2 * | 2/2005 | Berger | F24F 13/085 454/290 |
| 6,974,378 | B2 * | 12/2005 | Osada | B60H 1/3421 454/155 |
| 7,018,288 | B2 * | 3/2006 | Okada | B60H 1/3421 454/155 |
| 2002/0094774 | A1 * | 7/2002 | Demerath | B60H 1/345 454/320 |
| 2006/0079171 | A1 * | 4/2006 | Lu | F24F 13/1426 454/325 |
| 2010/0120347 | A1 * | 5/2010 | Gehring | B60H 1/345 454/155 |
| 2014/0302767 | A1 * | 10/2014 | Song | F24F 13/084 454/292 |
| 2014/0302768 | A1 * | 10/2014 | Song | F24F 13/1426 454/314 |
| 2014/0302770 | A1 * | 10/2014 | Song | F24F 13/12 454/325 |

* cited by examiner

AIR-CONDITIONING VENT VANE ADJUSTING DEVICE

BACKGROUND OF THE INVENTION

1. Field of Invention

The present invention relates to a component of a central air-conditioning system, and particularly to an air-conditioning vent vane adjusting device.

2. Description of Related Art

As people's standard of living standard improves, central air-conditioning is used extensively. Outdoor air-conditioning units are installed outdoors according to the required area of use, and air-conditioning terminals are installed in indoor rooms, such that air heated or cooled by the outdoor air-conditioning units can be transmitted into an air-conditioning vent of each room through a connecting pipeline and then passed out of the air-conditioning vent, so as to regulate the temperature, humidity and freshness of the air in the rooms to meet user requirements for comfort. In general, a conventional air-conditioning vent comprises a panel installed on a wall and disposed at a frame on an inner side of the panel, and a plurality of vanes rotatably mounted on two opposite sides of the frame, and the vanes have an end passing through the frame to connect a board. and the board is connected to a push-button on the panel by a connecting plate, so that the push-button can slide on the panel to drive the board to move reciprocally in order to open or close the vanes, and open or close the vent, and the control push-button can be moved to control the rotation angle of the vanes in order to adjust the air flow as disclosed in PRC Pat. No. CN201246856Y. entitled "A vane adjusting mechanism for wind gates".

SUMMARY OF THE INVENTION

In view of the aforementioned drawbacks of the prior art, it is a primary objective of the present invention to overcome the aforementioned drawbacks of the prior art by providing an air-conditioning vent vane adjusting device with the features of a labor-saving adjustment, a convenient installation, and a low cost.

To achieve the foregoing objectives, the present invention adopts the following technical measure and provides an air-conditioning vent vane adjusting device, comprising: a board for driving a vane to rotate, a push-button installed on a panel, and a connecting plate on the board, characterized in that a fixed plate is coupled to the push-button and capable of moving with the push-button, and the fixed plate includes a guide notch formed therethrough and tilted with respect to a longitudinal direction of the board; and the board has a lug accommodated in the guide notch and capable of sliding in the guide notch.

To take the convenience and easiness of manufacture and installation as well as the simplification of the structure into consideration, a connecting plate can be fixed onto the board, and the lug is disposed on the connecting plate.

Preferably, the included angle between the longitudinal directions of the guide notch and the board falls within a range of 40-50 degrees. The smaller angle of the pushing force, the better the hand feel.

In the aforementioned solution, the guide notch can be replaced by a groove. However, the opening structure can provide an easy installation. Specifically. the opening of the guide notch can be defined at the lower edge of the fixed plate.

Compared with the prior art, the present invention using the tilted guide notch and the lug together to drive the board to move reciprocally, so as to overcome the problem of the prior art that requires a large operating force of the push-button caused by the tight assembly of the conventional board and has the difficulty of opening and closing the vanes, so that the operation of the push-button has the features of moderate operating force, power saving, and good hand feel, and the present invention has the advantages of a simple structure, a convenient installation, and a low cost to better meet the current market requirements of the air-conditioning vent.

DETAILED DESCRIPTION OF THE INVENTION

Figure 1:
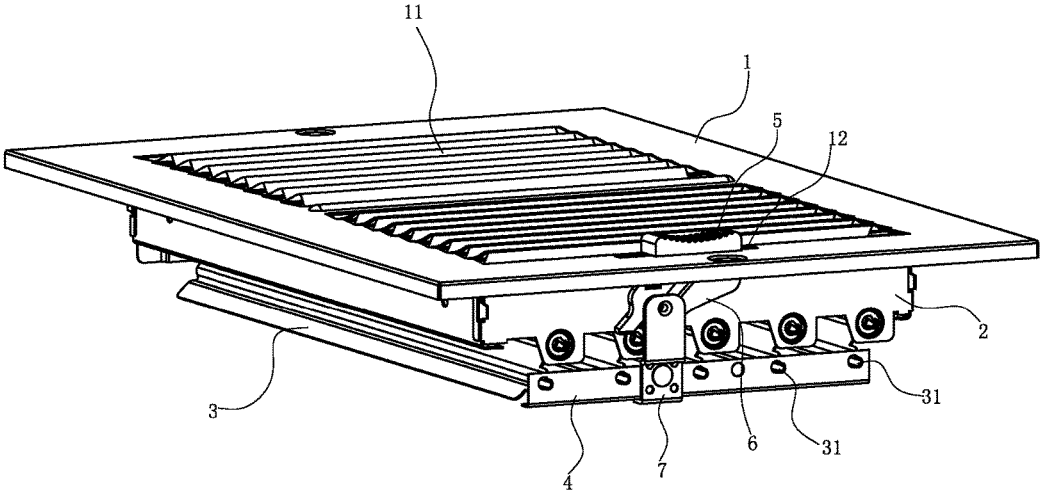
FIG. 1 is a perspective view of an assembly of a preferred embodiment of the present invention.
Figure 2:
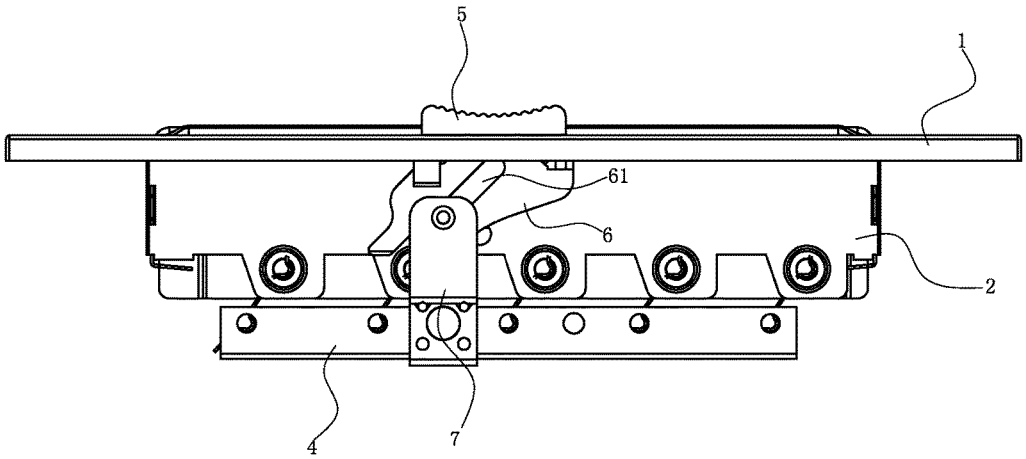
FIG. 2 is a planar view of the preferred embodiment of the present invention where the vane is fully closed.
Figure 3:
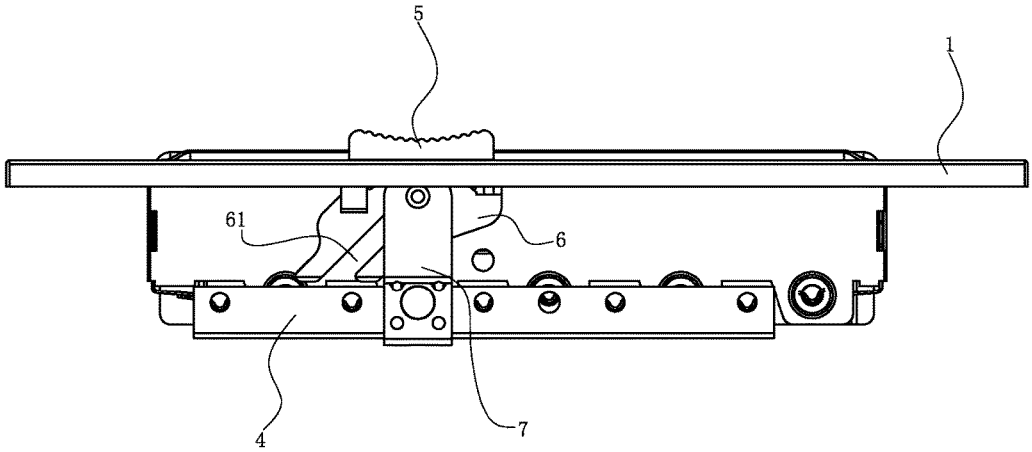
FIG. 3 is a planar view of the preferred embodiment of the present invention where the vane is not closed.

The technical characteristics and objectives of the present invention can be further understood by the following detailed description of preferred embodiments and related drawings.

With reference to FIGS. 1 to 5 for the structure of an air-conditioning vent used by an air-conditioning vent vane adjusting device in accordance with a preferred embodiment of the present invention, the air-conditioning vent comprises:

- a panel 1, including a grating 11, and a slide 12 disposed on the panel 1; a frame 2, installed on a wall, and disposed on an inner side of the panel 1, and provided as a connecting base for connecting components such as the panel 1, vanes 3, and a board 4, wherein the frame comes with a large frame structure;
- a plurality of vanes 3, with both ends rotatably mounted onto two opposite sides of the frame, and each vane having a connecting shaft 31 disposed on the same end of the vanes; and a board 4, corresponsive to the connecting shaft 31 for fixing and coupling the connecting shaft 31 therethrough.

In FIGS. 1 to 5, the air-conditioning vent vane adjusting device of this preferred embodiment further comprises:

- a push-button 5, installed on the panel 1, and having a lower portion passing through a slide formed on the panel 1 and disposed on an inner side of the panel, and the push-button 5 being capable of sliding in a longitudinal direction along the slide on the panel;
- a fixed plate 6, installed parallel to a side of the frame and disposed on an inner side of the panel, and coupled to the bottom of the push-button 5, such that the fixed plate 6 can be moved reciprocally by the sliding of the push-button, wherein the fixed plate includes a guide notch 61 tilted with respect to the longitudinal direction of the board, and an included angle of 45 degrees is defined between the longitudinal directions of the guide notch 61 and the board of this preferred embodiment, and the guide notch 61 is defined at a lower edge of the fixed plate; and a connecting plate 7, fixed and coupled to the diving board 4, and having a lug 71 disposed on the connecting plate 7 and accommodated in the guide notch 61, and capable of sliding in the guide notch 61 along the longitudinal direction of the guide notch 61.

Figure 4:
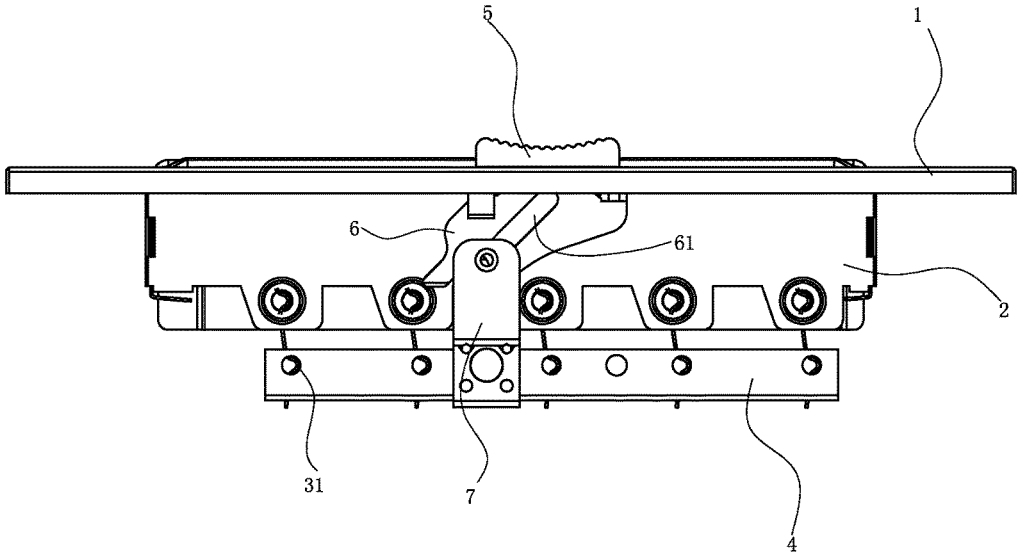
FIG. 4 is a planar view of the preferred embodiment of the present invention where the vane is fully opened.
Figure 5:
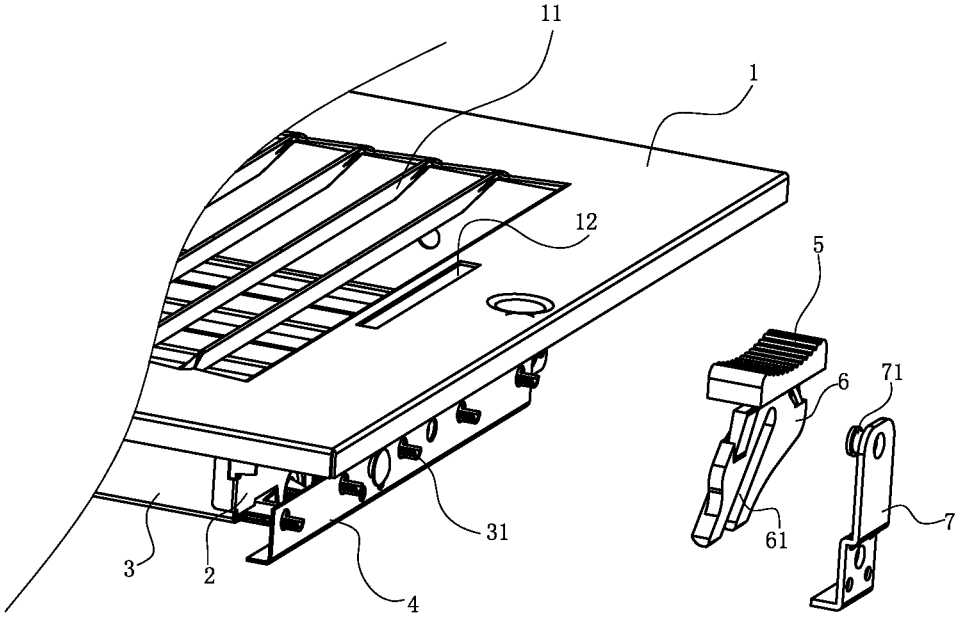
FIG. 5 is a partial exploded view of a preferred embodiment of the present invention.

The air-conditioning vent vane adjusting device is operated according to the following principle: To open the vanes for ventilation, the push-button is pushed on the panel, so that the push-button slides in the slide to drive the fixed plate connected to the push-button to move together. The lug slides in the guide notch, so that the connecting plate drives the board to move. The board pushes the connecting shaft on the vane, so that both ends of the vane rotate in the mounting hole of the frame to open the vane as shown in FIG. 4.

To close the vanes, the push-button is operated reversely.

To adjust the size of the opening of the air-conditioning vent, the push-button is pushed to a corresponding position.

What is claimed is:

1. An air-conditioning vent vane adjusting device, comprising a board for making a vane rotate, a push-button installed on a panel, and a fixed plate fixed to the push-button so that the fixed plate moves with the push-button, wherein the fixed plate includes a guide notch defined therethrough and tilted with respect to a longitudinal direction of the board; a connecting plate has a lug accommodated in the guide notch and capable of sliding in the guide notch, wherein one end of the guide notch is open-ended, and the guide notch is defined on a lower edge of the fixed plate; the connecting plate is immovably and non-rotatably fixed on the board, and the connecting plate extends a sliding distance of the lug in the guide notch; wherein when opening an air-conditioning vent for ventilation, the push-button is pushed on the panel so that the push-button slides to make the fixed plate connected to the push-button move together, the lug slides in the guide notch so that the connecting plate makes the board move, the board pushes a connecting shaft on the vane so that both ends of the vane rotate in a mounting hole of a frame to open the vane.

2. The air-conditioning vent vane adjusting device of claim 1, wherein the guide notch is tilted with respect to the longitudinal direction of the board in an angle of 40-50 degrees.

* * * * *